US006786939B2

(12) United States Patent
Hazel et al.

(10) Patent No.: US 6,786,939 B2
(45) Date of Patent: Sep. 7, 2004

(54) FUEL COMPOSITION

(75) Inventors: Clifford James Hazel, Cornwall (GB); Ian Vernon Williamson, Cheshire (GB)

(73) Assignee: AAE Technologies International PLC, Cork (IE)

( * ) Notice: Subject to any disclaimer, the term of this patent is extended or adjusted under 35 U.S.C. 154(b) by 0 days.

(21) Appl. No.: 10/081,735

(22) Filed: Feb. 22, 2002

(65) Prior Publication Data

US 2003/0163953 A1 Sep. 4, 2003

(Under 37 CFR 1.47)

Related U.S. Application Data

(63) Continuation of application No. 09/868,420, filed on Jun. 15, 2001, now abandoned, which is a continuation of application No. PCT/GB99/04155, filed on Dec. 15, 1999.

(30) Foreign Application Priority Data

Dec. 15, 1998 (GB) ..... 9827592

(51) Int. Cl.[7] ..... C10L 1/18

(52) U.S. Cl. ..... 44/388; 44/400; 44/418; 44/443

(58) Field of Search ..... 44/388, 400, 418, 44/443, 385, 393

(56) References Cited

U.S. PATENT DOCUMENTS 6,074,445 A * 6/2000 Ahmed ..... 44/385

FOREIGN PATENT DOCUMENTS

| | | | |
|---|---|---|---|
| EP | 0 466 511 A 1 | 1/1992 | |
| GB | 2217229 A * | 10/1989 | ..... B01F/17/00 |
| JP | 08198530 | 8/1996 | |
| WO | WO 98/17745 | 4/1998 | |

* cited by examiner

*Primary Examiner*—Cephia D. Toomer
(74) *Attorney, Agent, or Firm*—Darby & Darby

(57) ABSTRACT

A method is provided for reducing the vapour pressure (RVP) of a gasoline/alcohol mixture which comprises adding a surfactant composition comprising an alkanolamide, an alkoxylated alcohol and an alkoxylated fatty acid to a gasoline/alcohol mixture.

3 Claims, No Drawings

FUEL COMPOSITION

CROSS REFERENCE TO RELATED CASES

This application is a continuation of U.S. patent application Ser. No. 09/868,420, filed Jun. 15, 2001, now abandoned, which is hereby incorporated by reference in its entirety which is a continuation of PCT/G-B99/04155 filed Dec. 15, 1999.

The invention relates to a novel method of reducing the vapour pressure of fuels and to the new use of compositions.

It is well known that liquid fuels when burned in an internal combustion engine can give rise to pollution and other undesired side effects. Furthermore, the relatively high vapour pressure of most liquid hydrocarbon fuels is known to give rise to environmental and safety problems upon storage and transportation. Numerous proposals have been advanced to reduce these side effects and enhance efficiency, eg miles per gallon. It has been realised that surfactants can play a useful role in this context but so far as we are aware none has satisfied the modern commercial criteria. It is one object of this invention to meet the need.

According to the US Environmental Protection Agency (EPA), volatile organic compound (VOC) emissions from gasoline are, as ozone precursors, a major contributor to the nation's serious ground level ozone problem, which harms human health and the public welfare. In addition to automotive emissions, gasoline evaporation occurs during refining, during commercial handling, transportation, and storage, and during refuelling. Because gasoline evaporation is a significant environmental problem, work was initiated at the National Alternative Fuels Laboratory (NAFL) of the University of North Dakota Energy & Environmental Research Center (EERC) to investigate evaporation rates of various gasolines and gasoline-oxygenate blends and the composition of their evaporative emissions. One aspect of the work, which was funded by the US Department of Agriculture (USDA), was to compare evaporation rates and compositions of E10 evaporative emissions with those of nonethanol-blended base fuels.

Widespread commercial use of E10 fuels was originally promoted as a means to reduce gasoline consumption during the oil embargo of 1973. Current interest in ethanol as a transportation fuel involves its use as an oxygenate to reduce carbon monoxide (CO) combustion emissions. Also, its octane-boosting quality makes it useful as a replacement for octane-supplying aromatics that are slated for removal from reformulated gasolines to be sold in ozone non-attainment areas. Despite its desirable qualities as a fuel and the fact that it is renewable, ethanol has serious competition. Ethanol supporters are locked in a long-term debate with supporters of the other major commercially available gasoline oxygenate, methyl tertiary-butyl ether (MTBE), over which oxygenate is best for the environment.

A major point of contention in the debate is the approximate one-pound per square inch (psi) increase in RVP that occurs upon addition of ethanol to base fuel at a concentration of 10 vol %. However, while RVP is a useful indicator of a fuel's volatility, it is less useful as an indicator of how atmospheric interaction of vapour from the fuel (generated via evaporation or displacement during tank filling) may affect the environment in terms of ground level ozone production. Because gasolines are complex mixtures of over 200 components, the overall ozone-producing potential of a particular gasoline's vapour will depend not only on how much vapour is emitted, but also on the ozone-producing potential and concentration of each vapour component.

Surfactants have long had utility as additives which can affect the performance of fuels such as gasoline and diesel. British Patent No 2217229 describes a solubilising compound as a fuel additive. In particular there is described a composition comprising;

48 parts by volume of an alcohol ethoxylate;

3–8 parts by volume of lauric diethanolamide;

3–8 parts by volume of oleic diethanolamide; and 1.5–4 parts by volume of a polyglycol ether such as ethoxylated oleic acid.

Such compositions are useful as fuel additives and enable the solubilisation of water in fuels thus reducing its potential corrosive effect. However, the compositions are disadvantageous in that, inter alia, they require a high additive to fuel ratio. Furthermore, they do not address the problems of emissions of gases such as CO, $CO_2$ and NOX, nor do they address the problems of evaporative loss due to the high vapour pressure of the fuel composition.

International Patent Application No WO 98/17745 describes an alternative formulation which comprises, 25% w/w of a diethanolamide, 50% w/w of an ethoxylated alcohol, and 25% w/w of a fourteen carbon chain fatty acid with seven ethoxylate groups.

WO '745 especially describes fuel compositions comprising, inter alia, an additive made up of a fatty acid diethanolamide, an alcohol ethoxylate and an ethoxylate of a fatty acid, the degree of ethoxylation being selected so that a long term stable fuel composition is formed and, in particular, wherein, by carefully selecting the degree of ethoxylation, a balanced blend can be produced, such that the molecular weight ratios of each of the three components are substantially equivalent, for example, the molecular weight ratios are 1:1:1.

Whilst such additives provide significant reductions in emissions and are useable at low concentrations, there is still a need for a fuel composition which is capable of reducing emissions whilst maintaining performance levels.

It is known that to meet some legislation requirements fuels must have a low Reid Vapour Pressure value (RVP), e.g. under California State law, the RVP must be below 7 psi (0.48 atmospheres).

Some modern day gasoline contains a small percentage of the condensate from natural gas pipelines. Gasoline is made up from a range of hydrocarbons, which is determined by the refining and blending processes. They may also contain minor amounts of comparatively volatile contaminants picked up during transportation, for example, through pipe lines which have been previously used for transportation of natural gases. Pentanes are a range of C5 hydrocarbons that are typically left in the crude oil cut after the gas condensates are removed. Natural gas (methane) is extracted first from the oil field, ethane is increasingly also extracted at the well for petrochemical production of ethylene, while LPG, a mixture of C3 and C4 hydrocarbons, is liquefied under moderate pressure for use as a gas fuel. Pentane is usually the first cut off the Crude Distillation Unit at the refinery and the disposal of pentane creates a problem for the petroleum industry. Pentane has little value as a petrochemical feedstock, and blending it into the gasoline pool has the undesirable effect of raising the RVP. The aforementioned contaminants, as well as low boiling fractions arising from the refining and blending processes, all have the undesirable effect of increasing the vapour pressure of the gasoline. This undesirable effect will be further exacerbated if the fuel is blended with certain volatile oxygenating agents such as ethanol. Thus the condensate is a light fraction which is primarily pentanes although other hydrocarbons may be present. The condensate adversely affects the RVP, especially when the gasoline contains an alcohol such as ethanol.

It is known that when gasoline and an alcohol are mixed, the resultant mixture has an increased vapour pressure. We have now surprisingly found that by adding certain surfactant compositions to a gasoline and alcohol mixture a reduction in vapour pressure (RVP) can be achieved.

Thus, according to the invention we provide a method of reducing the vapour pressure of a gasoline/alcohol mixture which comprises adding a surfactant composition comprising an alkanolamide, an alkoxylated alcohol and an alkoxylated fatty acid, or an ester thereof characterised in that the RVP is less than 7 psi (0.48 atmospheres) to a gasoline/alcohol mixture.

By the term vapour pressure we mean the Reid Vapour Pressure (RVP). Thus the method of the invention preferably reduces the RVP of the gasoline mixture to less than 7 psi (0.48 atmospheres) and especially between 6(0.41 atmospheres) and 7 psi (0.48 atmospheres).

For the purposes of this invention the RVP is measured using the test method of ASTM D5191. Thus the vapour pressure is given at 37.8° C.

It is a novel aspect of the invention to use the aforementioned surfactant composition in the reduction of RVP.

According to a further aspect of the invention we provide the use of an additive composition as hereinbefore described in the manufacture of a fuel composition having an RVP of less than 7 psi (0.48 atmospheres).

The alkanolamide is preferably an ethanolamide and more preferably a diethanolamide. Especially preferred are the diethanolamides and particularly the super diethanolamides. By the term super diethanolamide we mean a diethanolamide in which the nitrogen is substituted by an alkyl substituent e.g. alkyl $C_5$ to $C_{20}$, preferably $C_8$ to $C_{16}$, more preferably $C_{10}$ to $C_{15}$. The most preferred diethanolamide has a $C_{12}$ alkyl substituent i.e. lauryl diethanolamide. Where the amides are derived from natural products this moiety will have an even number of carbon atoms, e.g. 12 for the lauryl derivative. Note, the alkyl part of this group is the R group which will be an odd number.

There are three commercial routes to alkanolamides;

Acid+alkanolamine=alkanolamide+water

Plant or animal oil (triglyceride)+alkanolamine=alkanolamide+glycerol

Methyl ester+alkanolamine=alkanolamide+methanol.

These are listed in order of increasing product quality. The route via the acid often uses an excess of alkanolamine to produce a product higher in amide than is obtainable from the acid if a stoichiometric ratio is used; these products are sometimes referred to as super amides.

The alkoxylated alcohol is preferably an ethoxylated alcohol. It is essential that the ethoxylated alcohol is an oil soluble alcohol. Therefore, alkanols are preferred and these may be primary, secondary or tertiary alkanols and especially primary alkanols. As the oil solubility of the alcohol may vary with the carbon chain length of the ethoxylated alkanol, the alkanol is preferably a $C_5$ to $C_{22}$ alkanol, more preferably $C_5$ to $C_{15}$ alkanol. The ethoxylated alcohol may comprise a mixture of alkanols. However, it is preferred that in such mixtures one alkanol will predominate. Thus, the most preferred alkanol is predominantly a $C_9$ to $C_{11}$ alkanol. In addition the degree of ethoxylation of the alcohol may be varied and the oil solubility will, generally, decrease with the increase in the degree of ethoxylation. It is preferred that the ethoxylate to alcohol ratio is greater than 2. More preferably, the ethoxylate to alcohol ratio is from between 1 and 10, preferably between 1 and 5, more preferably between 1 and 3 and especially between 2 and 3. A commercially available ethoxylated alcohol is especially preferred in which the ethoxylate to alcohol ratio is 2.75. Such an alcohol ethoxylate is available as NEODOL 91/2.5.

The fatty acid ethoxylate may comprise any conventionally known fatty acid ethoxylate. Thus the fatty acid ethoxylate may be derived from a fatty acid having from 8 to 20 carbon atoms, preferably from 10 to 18 and most preferably 14 carbon atoms (myristic acid).

The degree of ethoxylation is chosen to optimise performance in the blend with the other two selected surfactants and may be from 1 to 20, but more preferably from 5 to 12. A suitable product within this range would be, for example that derived from the addition of 7 molecules of ethylene oxide too 1 mole of myristic acid.

The values will depend on the length of the hydrophilic chain, typically an ethoxylate chain. The length of the chain will increase the extent of solubilisation because of a greater ability to solubilise.

As with the compositions described in WO98/17745, a blend of surfactants is preferred, preferably by selecting one appropriate to the fuel, say 10 to 18 for hydrocarbon fuel, most preferably 13. In the case of an alcohol the HLB value of the surfactant is between 3 and 7, most preferably about 4. But the addition of surfactants normally create ratios of 1:1 or high volume emulsions or 5:1 ratios when the solubalisation is required at 1:100.

The invention has the ability to unify the HLB requirements of any liquid fuel which in turn allows for one dose to be used in any fuel from C5 carbon chains up. The benefit being the amount of treatment directly related to the co-solvency ability.

Preferably the ethoxylate of the fatty acid makes up about 25% by volume of the additive and further preferably the alcohol ethoxylate comprises 50% by volume of the additive.

The surfactant additive may be added to a hydrocarbon fuel, eg diesel, petrol or alcohol, such as ethanol which may or may not be contaminated with water.

The fuel composition comprising a fuel and a fuel additive wherein the additive to fuel ratio is 0.5–1:1200.

The alcohol to hydrocarbon fuel ratio is from 1:8 to 1:9. Water may be present, e.g. as condensate, or added separately, in water: alcohol: fuel ratio of 0:1:8 to 0.5:;1:9 and preferably from 0.25:1:8 to 0.25:1:9.

The additive may be present in an additive to fuel/alcohol ratio of about 0.5–1:1000. Preferably the additive to fuel ratio is about 1:1000, most preferably about 1:1200. In this context the fuel is the hydrocarbon fuel and alcohol mixture.

EXAMPLE 1

Different blends shown in Table 1 were made and subjected to gas chromatography. The ratio of hydrocarbon:ethanol was measured by gas chromatography. The results were used to indicate the extent to which the content of the ethanol could be incorporated without exceeding an increase in the temperature at which the volatile ingredients evaporated. The results showed the amount of ethanol that could be incorporated into the hydrocarbon without increasing the temperature at which the volatile components evaporated.

The additive comprised 60% by weight ethanolethoxylate, 20% by weight diethanolamide and 20% by weight of lauric diethanolamide. Our investigation suggests that these interact to form a blend in which the ethanolamide is a backbone.

EXAMPLE 2

Different blends were made up and the RVP determined. The following results were obtained:

TABLE II

| Sample | Gasoline | Ethanol | Additive as above | Water | RVP (1) | RVP (2) | RVP (3) |
|---|---|---|---|---|---|---|---|
| 1 | 90 | 10 | — | — | 7.48 | 7.7 | 7.58 |
| 2 | 87.5 | 10 | 2.5 | — | 7.18 | 7.41 | 7.29 |
| 3 | 85.0 | 10 | 2.5 | 2.5 | 6.87 | 7.11 | 6.98 |
| 4 | 85.0 | 10 | 2.5 | 2.5 | 6.96 | 7.19 | 7.06 |

The RVP value was measured according to ASTM D5191 and is the mean value of results calculated according to CARB (1), EPA (2) and ASTM (3) methods. In Samples 2, 3 and 4 the gasoline included a proportion of a condensate which was mainly pentanes. These results demonstrate a tendency of the additive to reduce the RVP value, and that by selecting appropriate proportions a fuel composition can be made to meet the requirements of local legislation.

TABLE 1

| Sample | Hydrocarbon (a) | Ethanol (b) | Pentane | Additive | Ratio (a):(b) |
|---|---|---|---|---|---|
| 1 | 90 | 10 | 0 | 0 | 15:1 |
| 2 | 89 | 10 | 0 | 1 | 16.7:1 |
| 3 | 82 | 13.5 | 4.5 | 0 | 17.75:1 |
| 4 | 77.5 | 13.5 | 4.5 | 4.5 | 11.69:1 |

EXAMPLE 3

Various tests were conducted according to ASTM D-5191. The results are given in Tables III to IX.

EXAMPLE 4

Various tests were conducted according to the 1975 US Federal City Gasoline Test. The results are given in Tables X to XIII;

| | |
|---|---|
| Table X: | Tests on CARB Gasoline |
| Table XI: | Tests on EPA |
| Table XII: | Tests on Gasohol |

What is claimed is:

1. A method of reducing the vapour pressure (RVP) of a gasoline/alcohol mixture which comprises adding a surfactant composition comprising an alkanolamide, an alkoxylated alcohol and an alkoxylated fatty acid alkyl ester to a gasoline/alcohol mixture wherein the RVP is less than 0.48 atmospheres.

2. A method according to claim 1, wherein the alkyl group is a $C_1$ to $C_{10}$ alkyl.

3. A method according to claim 1, wherein the composition comprises 25% v/v of the fatty acid ester.

* * * * *